US010421075B2

(12) United States Patent
Roper

(10) Patent No.: US 10,421,075 B2
(45) Date of Patent: Sep. 24, 2019

(54) GRINDING APPARATUS HAVING A ROTATING RECEPTACLE AND GRINDING ELEMENT

(71) Applicant: JTG and Partners Pty Ltd., Adelaide, Queensland (AU)

(72) Inventor: Linden David Roper, Almaty (KZ)

(73) Assignee: JTP AND PARTNERS PTY LTD., Adelaide (AU)

( * ) Notice: Subject to any disclaimer, the term of this patent is extended or adjusted under 35 U.S.C. 154(b) by 740 days.

(21) Appl. No.: 14/891,717

(22) PCT Filed: May 14, 2014

(86) PCT No.: PCT/AU2014/000519
§ 371 (c)(1),
(2) Date: Nov. 17, 2015

(87) PCT Pub. No.: WO2014/186821
PCT Pub. Date: Nov. 27, 2014

(65) Prior Publication Data

US 2016/0114330 A1 Apr. 28, 2016

(30) Foreign Application Priority Data

May 20, 2013 (AU) ..... 2013901788

(51) Int. Cl.
*B02C 2/04* (2006.01)
*B02C 2/00* (2006.01)
(Continued)

(52) U.S. Cl.
CPC ..... *B02C 2/047* (2013.01); *B02C 2/00* (2013.01); *B02C 2/04* (2013.01); *B02C 2/045* (2013.01);
(Continued)

(58) Field of Classification Search
CPC ... B02C 13/284; B02C 17/1855; B02C 23/10; B02C 23/16; B02C 2023/165;
(Continued)

(56) References Cited

U.S. PATENT DOCUMENTS 2,158,779 A 5/1939 Rumpel
2,181,571 A * 11/1939 Stearns ..... B02C 2/06 241/156
(Continued)

FOREIGN PATENT DOCUMENTS

CN 1153486 A 7/1997
DE 830281 C 2/1952
(Continued)

OTHER PUBLICATIONS

International Search Report dated Jul. 7, 2014 for Application No. PCT/AU2014/000519.
(Continued)

*Primary Examiner* — Jonathan Ng
*Assistant Examiner* — Christopher B Wehrly
(74) *Attorney, Agent, or Firm* — Patterson + Sheridan, LLP

(57) ABSTRACT

A grinding apparatus includes a receptacle, a grinding element and a drive means. The receptacle has a receptacle inner wall defining a receptacle cavity. The receptacle inner wall is in the general form of a surface of a revolution extending about a central vertically extending receptacle axis. The receptacle is rotatable about the receptacle axis. The grinding element has a grinding element outer wall in the general form of a surface of revolution extending about a central vertically extending grinding element axis.

25 Claims, 10 Drawing Sheets

(51) Int. Cl.
*B02C 23/10* (2006.01)
*B02C 23/18* (2006.01)

(52) U.S. Cl.
CPC ..... *B02C 23/10* (2013.01); *B02C 23/18* (2013.01); *B02C 2002/002* (2013.01)

(58) Field of Classification Search
CPC ..... B02C 17/186; B02C 23/18; B02C 2/047; B02C 2/04; B02C 2/045; B02C 2/00; B02C 2/02; B07B 13/04; E21B 7/18; E21B 4/02; D06F 39/081; D06F 39/083
USPC ..... 241/69–81, 208, 52, 80, 96, 32, 222, 57, 241/38, 41, 207–216, 226, 212
See application file for complete search history.

(56) References Cited

U.S. PATENT DOCUMENTS 4,179,076 A 12/1979 Barrot et al.
4,478,373 A * 10/1984 Gieschen ..... B02C 2/045 241/208
4,964,580 A * 10/1990 Akesaka ..... B02C 2/00 241/252
5,718,391 A * 2/1998 Musil ..... B02C 2/045 241/207
6,213,418 B1 4/2001 Gabriel et al.
6,981,665 B2 * 1/2006 Braun ..... B02C 2/045 241/207
7,810,749 B2 10/2010 Stemper
8,091,817 B2 * 1/2012 Fried ..... B02C 15/04 241/201
8,308,095 B2 11/2012 Solomon et al.
2008/0099589 A1 5/2008 Stemper
2012/0118644 A1 * 5/2012 Vandenbulcke ..... E21B 7/18 175/65
2012/0187224 A1 7/2012 Repinski et al.

FOREIGN PATENT DOCUMENTS

WO 9633807 A1 10/1996
WO 2012/149889 11/2012

OTHER PUBLICATIONS

Chilean Examination Report dated Nov. 20, 2017, for Chilean Patent Application No. 201503386.
EPO Supplementary European Search Report dated Dec. 15, 2016, for European Patent Application No. 14800376.7.

* cited by examiner

GRINDING APPARATUS HAVING A ROTATING RECEPTACLE AND GRINDING ELEMENT

FIELD

The present invention relates to the field of material processing and particularly relates to a grinding apparatus for comminution of solid materials.

BACKGROUND

In the mineral processing industry, comminution is the process by which solid materials are reduced in size, typically by crushing and then subsequent grinding processes, particularly to liberate valuable minerals from the mined material in which they are embedded. Comminution processes are also employed in various other industries, including cement, fertiliser, solid fuel, textile and pharmaceutical industries.

Grinding operations are commonly carried out in tumbling mills, which achieve size reduction of feed material particles by impact and attrition. Known forms of tumbling mills include:

- ball mills, in which the feed material is ground by friction and impact with grinding media in the form of tumbling balls in a rotating cylindrical chamber;
- autogenous mills, in which larger particles of the feed material itself replace the balls of a ball mill as the grinding media, and
- semi-autogenous mills, which use larger particles of the feed material, aided by balls, as the grinding media.

Autogenous and semi-autogenous tumbling mills typically reduce feed material particles from up to notionally 200 mm down to a product size of about 75 μm, whilst ball mills typically reduce feed material particles from up to notionally 15 mm to a product size of about 20 μm. These conventional tumbling mills are generally accepted to be energy inefficient processes. It has been estimated that the energy efficiency for these processes range from about 0.1% to 2%, based on the generation of new surface area. Operation of tumbling mills requires a substantial amount of energy to rotate the large cylindrical chambers filled with grinding media, feed material particles and slurry (created with the addition of process fluid to the chamber). Most of the input energy is dissipated in the form of heat and noise.

Another more recently adopted form of grinding is by way of high pressure grinding rolls, which compress a material bed of feed material particles between contra rotating rollers. High pressure grinding rolls have proved to be more energy efficient in reduction of feed material particle sizes from up to notionally 70 mm to a product size of about 4 mm. High pressure grinding rolls are reported to be 10% to 50% more energy efficient than tumbling mills, with less sensitivity to changes in feed material hardness. High pressure grinding rolls are, however, limited to dry grinding, with a maximum moisture content of about 10%. This limitation is caused by sliding friction on the rollers, whilst they draw feed material into the compression zone formed in the material bed. Specific compression pressure used between the rollers is typically within the range of 3 to 5 MPa. Micro-cracking of the feed particles benefit further downstream comminution, which is a further benefit of high pressure grinding rolls.

OBJECT OF INVENTION

It is an object of the present invention to provide an improved grinding apparatus to supplement, or replace, or at least to provide a useful alternative to, prior art forms of grinding apparatus.

SUMMARY OF INVENTION

The present invention provides a grinding apparatus comprising:

- a receptacle having a receptacle inner wall defining a receptacle cavity, said receptacle inner wall being in the general form of a surface of revolution extending about a central vertically extending receptacle axis, said receptacle being rotatable about said receptacle axis;
- a grinding element having an grinding element outer wall in the general form of a surface of revolution extending about a central vertically extending grinding element axis, said grinding element axis being generally parallel to said receptacle axis, and offset from said receptacle axis by an offset distance, said receptacle inner wall and said grinding element outer wall together defining a grinding chamber within said receptacle cavity, said grinding chamber having a generally annular cross-section; and
- a drive means adapted to rotationally drive said grinding element about said grinding element axis and/or to rotationally drive said receptacle about said receptacle axis.

In one form, said drive means is adapted to rotationally drive said grinding element only.

In an alternate form, said drive means is adapted to rotationally drive said grinding element and said receptacle.

In a preferred form, said grinding chamber has a feed inlet at an upper end of said receptacle.

In a preferred form, said receptacle inner wall tapers towards said feed inlet, and said grinding element outer wall tapers towards said feed inlet.

In a particular form, along any radial plane, a width of said grinding chamber, defined as the minimum distance between said grinding element outer wall at a given point in the radial plane and said receptacle inner wall, tapers towards a lower end of said grinding chamber.

In a preferred form, said offset distance is selectively adjustable.

In a preferred form, said grinding element comprises a grinding element head defining said grinding element outer wall and a grinding element shaft rotatably mounted within an eccentric arrangement configured to selectively displace said grinding element axis to adjust said offset distance.

Preferably, an annular gap is defined between said receptacle and said grinding element at a radially outer extremity of said grinding chamber, said annular gap defining a circumferentially extending discharge outlet.

In a preferred form, said annular gap is selectively adjustable.

In a preferred form, said annular gap is adjustable to a closed state.

In one embodiment, said receptacle is mounted within a housing by a screw threaded arrangement operable to adjust said annular gap.

In a preferred form, said grinding element further comprises an annular dam defining a circumferentially extending periphery of said grinding element, said annular gap being defined between a top edge of said annular dam and a lower face of said receptacle.

In a preferred embodiment, an overflow passage extends through said grinding element between an upper portion of said grinding chamber and an exterior of said grinding chamber.

In one embodiment, a fluid feed passage extends through said grinding element and communicates with said grinding chamber.

In a preferred form, said grinding apparatus further comprises a screen located beneath said grinding chamber for receipt of material discharged from said grinding chamber and configured to allow material below a predetermined size to pass through said screen.

In a preferred form, said screen extends circumferentially about said grinding element.

In a preferred form, said screen is rotationally fixed in relation to said receptacle.

In a preferred form, said grinding apparatus further comprises an oversize product chute arranged on said screen to guide material exceeding said predetermined size from a top surface of said product screen.

In a preferred form, said grinding apparatus further comprises grinding media in said grinding chamber.

In one embodiment, said grinding apparatus further comprises a suspension system providing for relative vertical displacement between said grinding element and said receptacle in the event of incompressible material in said grinding chamber becoming wedged between said receptacle inner wall and said grinding element outer wall.

In one form, said suspension system comprises a plurality of hydraulic jacking rams.

In one form, said hydraulic jacking rams are configured to selectively adjust said annular gap defining said discharge outlet.

In a preferred form, said receptacle comprises a receptacle body and a replaceable receptacle liner mounted on said receptacle body and defining said receptacle inner wall.

In a preferred form, said grinding element comprises a grinding element body and a grinding element liner mounted to said grinding element body and defining said grinding element outer wall.

BRIEF DESCRIPTION OF DRAWINGS

Preferred embodiments of the present invention will now be described, by way of example only, with reference to the accompanying drawings wherein.

DESCRIPTION OF EMBODIMENTS

Figure 1:
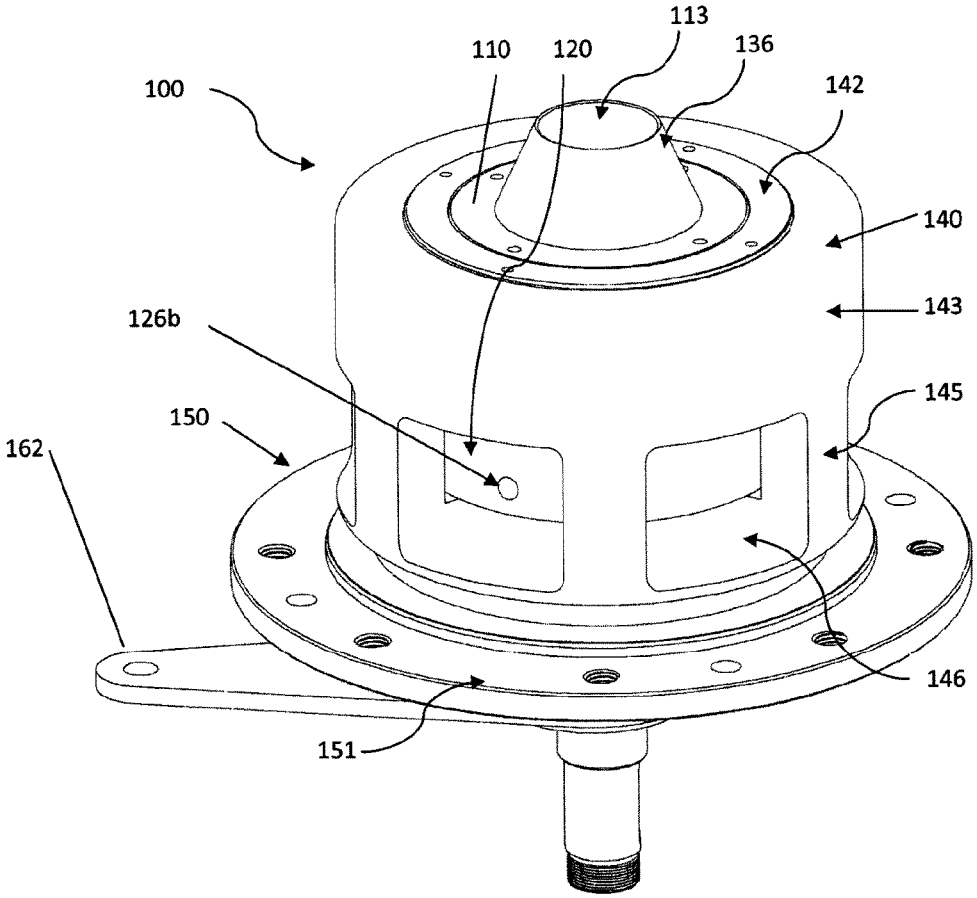
FIG. 1 is a schematic isometric view of a grinding apparatus according to a first embodiment.
Figure 2:
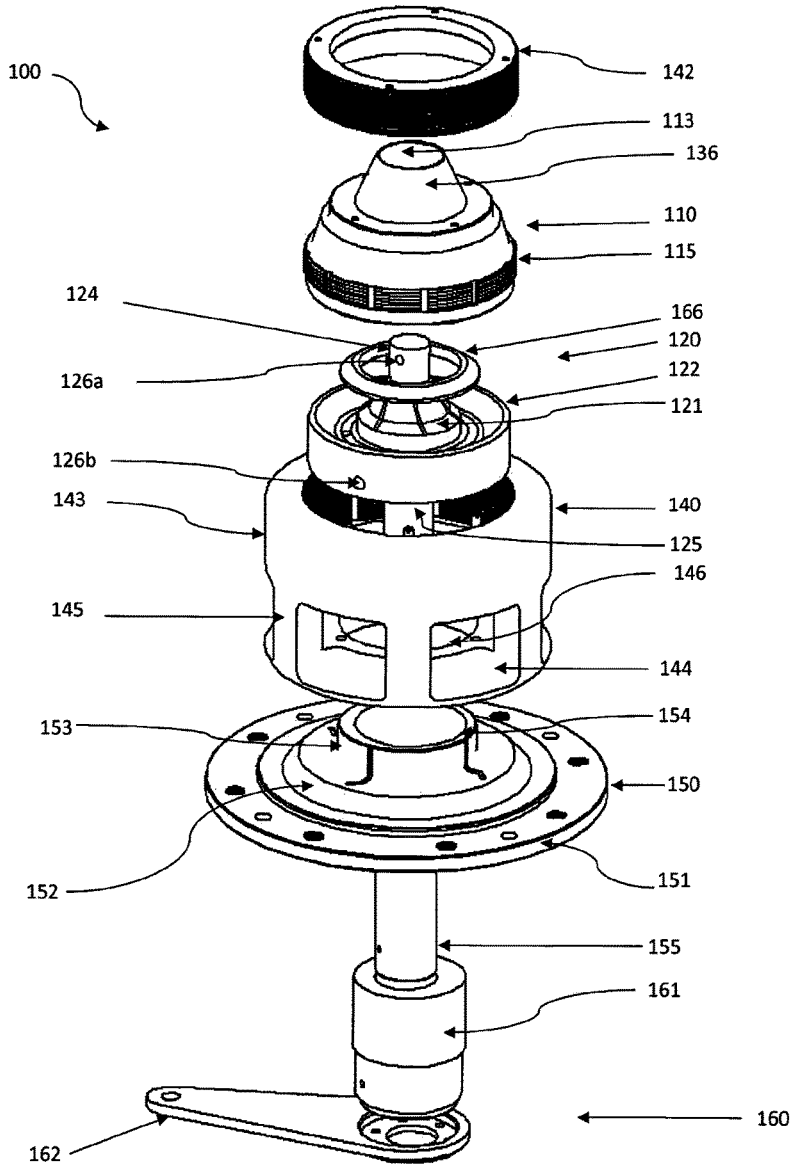
FIG. 2 is an exploded view of the grinding apparatus of FIG. 1.
Figure 3:
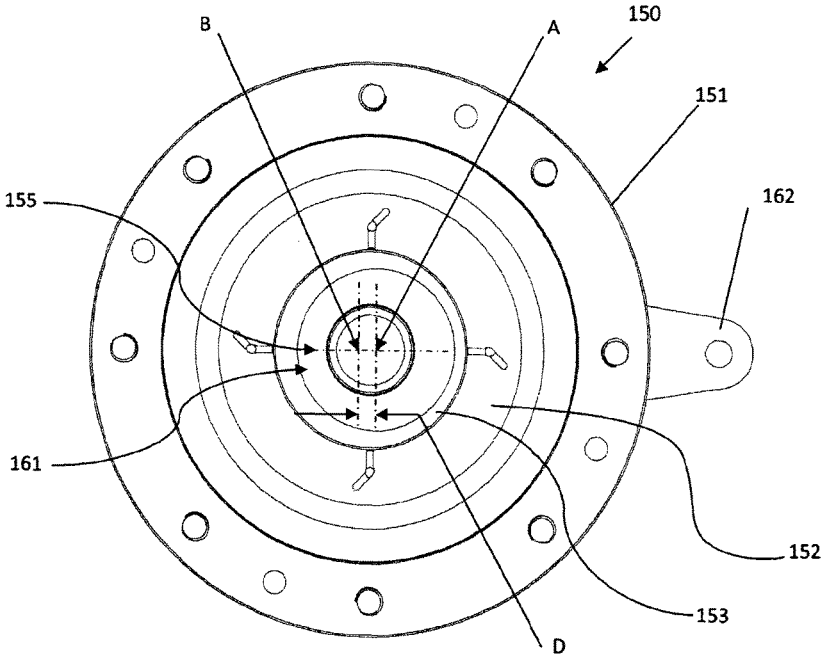
FIG. 3 is a plan view of the base and eccentric arrangement of the grinding apparatus of FIG. 1.
Figure 4:
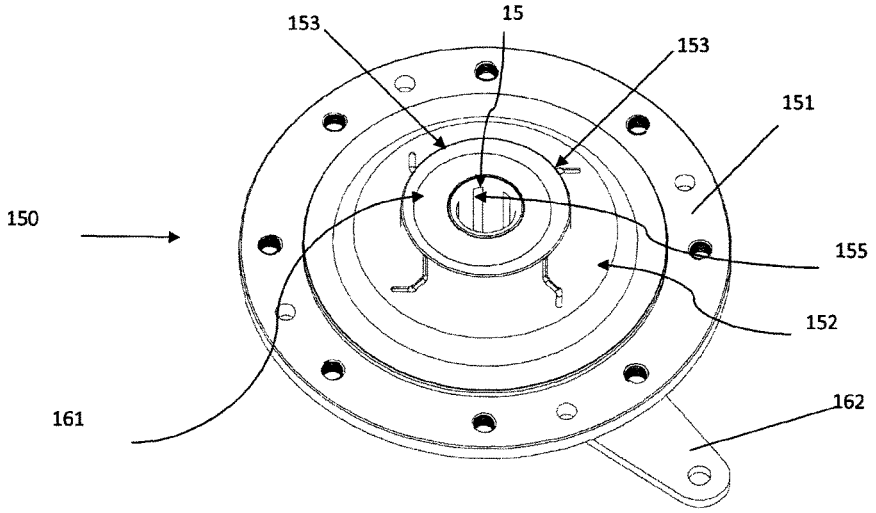
FIG. 4 is an isometric view of the base and eccentric arrangement of FIG. 3.

A grinding apparatus 100 according to a first embodiment is depicted in FIGS. 1 to 6 of the accompanying drawings. The grinding apparatus 100 depicted is of a relatively small "pilot" form, configured to receive feed process particles of up to 40 mm in size and of a nominal compressive strength of between 3 and 8 MPa. The grinding apparatus 100 has an overall diameter of approximately 350 mm. The grinding apparatus 100 has a receptacle 110, a grinding element 120, a housing 140, a base 150 and an eccentric arrangement 160.

Figure 5:
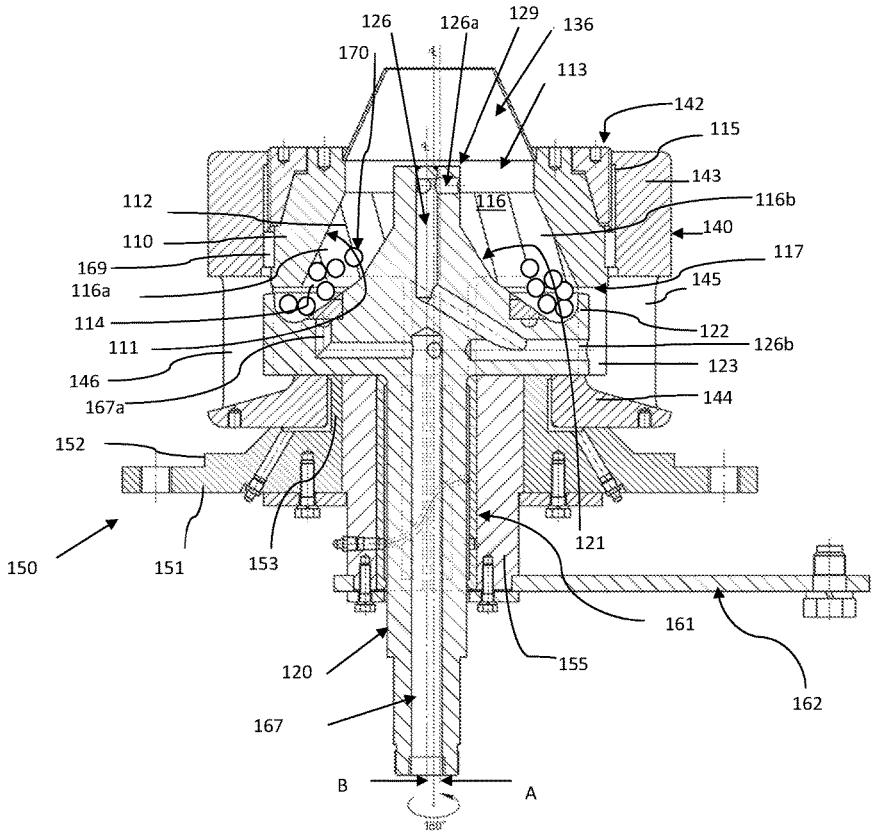
FIG. 5 is a schematic cross-sectional view of the grinding apparatus of FIG. 1, with the grinding element eccentrically offset from the receptacle.

Referring specifically to FIG. 5, the receptacle 110 has a receptacle inner wall 111 defining a receptacle cavity 112. The receptacle cavity 112 has an upper receptacle opening forming a feed inlet 113 defined in the upper face of the receptacle and a receptacle lower opening 114 defined in the lower face of the receptacle 110. A feed chute 136 is mounted on the top of the receptacle 110, extending upwardly from the feed inlet 113. In the configuration depicted, the feed chute 136 is of frustoconical form so as to restrain feed particles (and process fluid, where utilized) that may be forced upward and outward by centrifugal force during operation. The receptacle inner wall 111 is in the form of a surface of revolution extending about a central vertically extending receptacle axis A. In the first embodiment, the receptacle inner wall 111 tapers upwardly towards the feed inlet 113 and here has a generally frustoconical form. The receptacle 110 is arranged so as to be rotatable about the receptacle axis A. The receptacle axis A is stationary. The receptacle 110 is mounted in the housing 140, here by way of mating screw threads formed on the receptacle outer wall 115 and the housing inner wall 141. An externally threaded lock ring 142 engages the screw thread of the housing inner wall 141, above the receptacle 110, to lock the receptacle 110 in place within the housing 140. Vertically extending keyways are also formed on the receptacle outer wall 115 and housing inner wall 141, with keys 169 located in the aligned keyways to further lock the receptacle 110 against rotation relative to the housing 140. Other forms of locking device may alternatively be utilized as desired.

The receptacle 110 may be removed from the housing 120 for replacement or refurbishment, particularly following wear of the receptacle inner wall 111. A spare receptacle 110 may be held to replace a worn receptacle 110 whilst it undergoes refurbishment. The receptacle 110 may comprise a receptacle body and a replaceable receptacle liner mounted on the receptacle body and defining the receptacle inner wall 111. In arrangements where the receptacle 110 is of unitary form, it may be formed, for example, from a carbon steel with 350 Brinnel hardness of bearing surfaces. In arrangements where the receptacle comprises a separate receptacle body and receptacle liner, the receptacle body may be formed, for example, from fine high-grade cast steel. The receptacle liner may be formed from any suitable high wear lining material. Suitable materials include high carbone cast (13-14%) manganese steel, chrome-moly, decolloy or other alloys.

The grinding element 120 has a grinding element outer wall 121 that is also in the general form of a surface of revolution. The grinding element outer wall 121 extends about a central vertically extending grinding element axis B. In the first embodiment, the outer grinding element wall tapers upwardly towards the top of the grinding element 120 (and thus toward the feed inlet 113) and is here of a general frustoconical form. The grinding element axis B is generally parallel to the receptacle axis A and is offset from the receptacle axis A by an offset distance D. The surface texture of the grinding element outer wall 121, whether defined by a separate grinding element liner or integrally formed grinding element, may have a texture as specified by the operator and as dictated by operational requirements and experience. It is envisaged that the upper region of the grinding element outer wall 121 may be provided with surface irregularities to facilitate putting energy into larger size feed particles that may otherwise slide and avoid entering the compression zone as will be discussed below.

The grinding element 120 is removable from the housing 140, following removal of the receptacle 110, for replacement or refurbishment, particularly following wear of the grinding element outer wall 121. The grinding element 120 may comprise a grinding element body and a replaceable grinding element liner mounted on the grinding element body and defining the grinding element outer wall 121. The grinding element 120, including any separate grinding element liner, may be formed of the same or similar materials to the receptacle 110 (and separate receptacle liner) identified above.

The receptacle inner wall 111 and grinding element outer wall 121 together define a grinding chamber 116 within the receptacle cavity 112. The grinding chamber 116 has a generally annular cross-section, although as will be appreciated, particularly from FIG. 5, the offset of the grinding element 120 from the receptacle 110 results in a non-uniform annular cross-section in any given horizontal plane. The generally frustoconical form of the grinding element outer wall 121 has a greater taper angle than that of the frustoconical form of the receptacle inner wall 111. Accordingly, along any radial plane, the width of the grinding chamber 116, defined as the minimum distance between the grinding element outer wall 121 at any given point along the radial plane and the receptacle inner wall 111, tapers towards the lower end of the grinding chamber 116. It is envisaged, however, that the width of the grinding chamber 116 will not taper in some configurations.

The grinding element 120 has an upwardly projecting annular dam 122 defining a circumferentially extending periphery of the grinding element 120. Between the annular dam 122 and the grinding element outer wall 121 is defined an annular channel 123 defining the base of the grinding chamber 116. Between the upper edge of the annular dam 122 and the lower face of the receptacle 110 is defined an annular gap, which forms a discharge outlet 117 of the grinding chamber 116, for the passage of discharge particles which have been ground in the grinding chamber 116 to a size smaller than the gap defining the discharge outlet 117. The annular gap defining the width of the discharge outlet 117 may be adjusted by screwing the receptacle 110 upwardly or downwardly relative to the housing 140 by virtue of the screw threaded arrangement mounting the receptacle 110 within the housing 140. To adjust the annular gap, the lock ring 142 and keys 169 rotationally locking the receptacle 110 relative to the housing 140 must first be removed. The keys 169 and lock ring 142 are then reinserted once the desired annular gap has been achieved.

In the first embodiment, the annular gap may be adjusted between 0 mm (closing the discharge outlet 117) and 10 mm selectively. The minimum width of the grinding chamber 116 will typically be no less than three times the maximum annular gap defining the discharge outlet 117 used in normal operation. Where it is desired to close the discharge outlet 117, a hydrostatic water seal may be used to protect the horizontal sealing faces. Sealing water for such a seal may be delivered via passages in the grinding element from a rotating hydraulic union attached to the top of the grinding element 120. The sealing faces may otherwise be formed of materials that resist abrasion and provide minimum friction, allowing the annular gap to be fully closed and sealed without provision of a separate seal. It is still further envisaged that a flexible seal may be attached to either the upper edge of the annular dam 122 or the lower face of the receptacle 110 so as to seal the annular gap without bringing the opposing faces into direct contact.

In the first embodiment, the grinding element 120 comprises a grinding element head 124, which incorporates the grinding element outer wall 121 and annular dam 122, and a grinding element shaft 125, which extends downwardly from the grinding element head 124 about the grinding element axis B.

An overflow passage 126 extends through the grinding element head 124, from adjacent the upper end of the grinding element outer wall 121 to the outer face of the annular dam 122, thereby providing an additional discharge outlet from the grinding chamber 116 in addition to the discharge outlet 117. The overflow passage 126 will particularly provide an alternate discharge route for excess process fluid, which may be added to the grinding chamber 116 as will be discussed below, or slurry containing discharge particles. It is also envisaged that the overflow passage 126 may form the primary discharge outlet from the grinding chamber 116 in configurations where the annular gap defining the discharge outlet 117 has been closed by adjusting the location of the receptacle 110, as may be desirable in certain applications. The entry **126*a* of the overflow passage 126 opens radially and is protected from the ingress of feed particles fed through the feed inlet 113 by way of an overhanging cap 129 of the grinding element 116 located above the grinding element outer wall 121. The overflow passage outlet 126*b* extends radially through the lower outer face of the grinding element head 124**.

A fluid feed passage 167 extends axially through the grinding element shaft 125, with a rotatory union being provided at the base of the grinding element shaft 125. The fluid feed passage 167 extends radially through the grinding element head 124 and then vertically to a fluid feed passage outlet section **167*a* that communicates with the annular channel 123 defining the base of the grinding chamber 116, via a one-way valve in the form of a protector ring 166. The protector ring 166 fits loosely within a recess formed in the grinding element outer wall 121 and covers the fluid feed passage outlet section 167*a* and an annular gully 168 communicating with the fluid feed passage outlet section 167*a*. The protector ring 166 allows process fluid injected through the fluid feed passage 167 to enter into the grinding chamber 116, whilst preventing solid particles from entering the fluid feed passage outlet section 167*a*. The injection of process fluid into the fluid feed passage 167 would be particularly useful when the annular gap defining the discharge outlet 117 has been closed, allowing the process fluid to sweep fine particles up and out of the grinding chamber 116 against centrifugal force and gravity via the overflow passage 126**.

The base 150 is of a generally annular form comprising an annular flange 151, outer boss 152 and inner boss 153. The annular flange 151 may be used to secure the grinding apparatus to an underlying support structure. An aperture 154 extends through the outer and inner bosses 152, 153. The aperture 154 is eccentrically offset from the centre of the inner boss 153. The grinding element 120 is mounted on the base 150 with the grinding element shaft 125 extending through the aperture 154. The grinding element 125 is specifically mounted through the aperture 144 within a cylindrical first bush 155 that is in turn mounted within an eccentric bush 161 that forms part of the eccentric arrangement 160. The first bush 155 may suitably be formed, for example, from bronze containing 8-14% tin with 60-80 Brinnel hardness. The first bush 155 may be hydrostatically or hydro-dynamically lubricated to assist in providing unrestricted rotation of the grinding element 120. In the configuration depicted, this lubrication is provided by way of a lubrication passage 135 extending through the first bush 159 and the eccentric bush 161. The lower face 127 of the grinding element head 124 is supported on the upper face of the housing floor 144 of the housing 140, typically, with hydrostatic lubrication of the bearing surfaces so as not to inhibit relative rotation between the grinding element 120 and housing 140 (for configurations where the grinding element 120 and housing 140 are not coupled to be rotationally driven together). In the configuration depicted, this lubrication is provided by way of a further lubrication passage 134 extending through the outer boss 152 of the base 150. The lower face 127 of the grinding element head 124 has a clearance with the upper faces of the inner boss 153, the eccentric bush 161 and the first bush 155.

The housing 140 has a housing body 143 defining the housing inner wall 141 and a disc shaped housing floor 144 located beneath the housing body 143 and separated from the housing body 143 by way of circumferentially spaced struts 145. The struts 145 are separated by openings 146 for the passage of discharge particles passing through the discharge outlet 117. The housing floor 144 is supported on the upper face of the outer boss 152 of the base 150, typically with hydrostatic lubrication of the bearing surfaces so as not to inhibit relative rotation between the housing 140 and the base 150. Lateral displacement of the housing 140 (and thereby the receptacle 110) relative to the base 150 is prevented by engagement of the inner face of the housing floor 144 and the outer face of the inner boss 153 of the base 150. This engagement may be via a cylindrical second bush assisting providing free rotation of the housing 140 (and thus the receptacle 110) relative to the base 150. As with the first bush 155, such a second bush 156 will typically be formed of bronze containing 8-14% tin with 60-80 Brinnel hardness, typically with hydrostatic lubrication of the bearing surfaces so as not to inhibit relative rotation.

The grinding element 120 is rotationally driven about the grinding element axis B by way of a drive means (not depicted) rotating the grinding element shaft 125. The drive means may be in the form of a motor and gear system, a motor and belt drive system, an hydraulic motor or any other suitable form of drive. For the particular configuration and size of the grinding apparatus 100, a drive motor with power output of the order of 45 kW is envisaged, driving the grinding element 120 at a speed of the order of 300 rpm, which may be variable.

Figure 6:
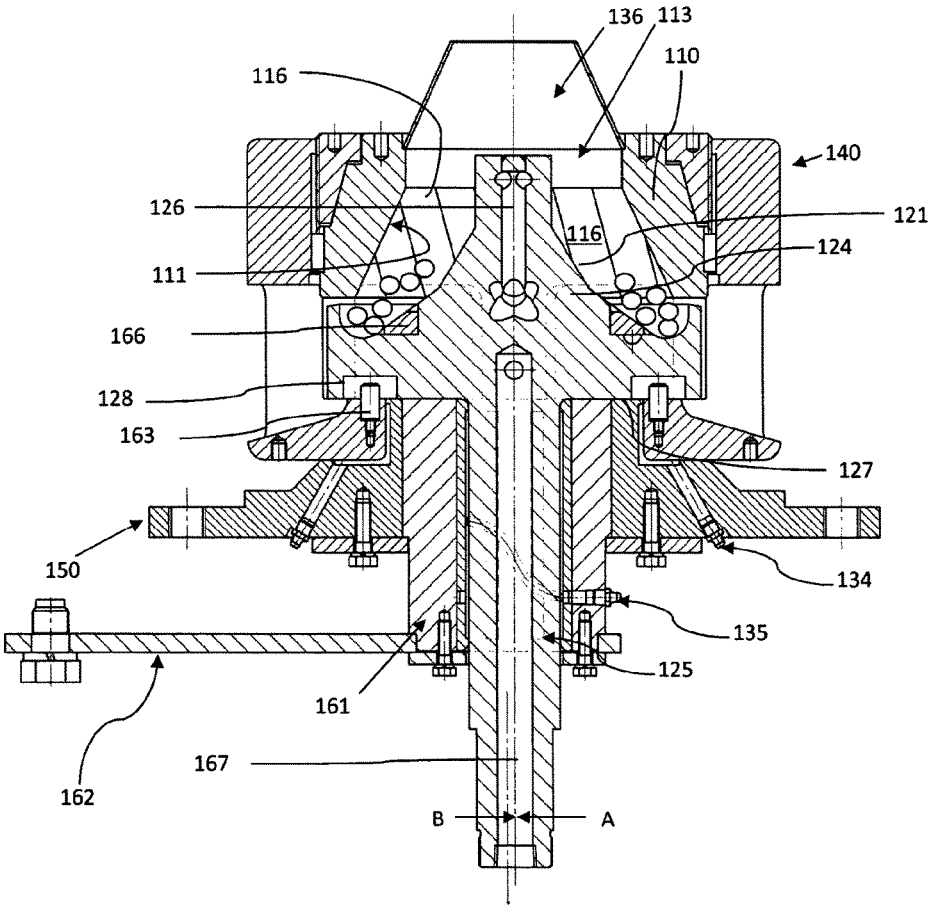
FIG. 6 is a schematic cross-sectional view of the grinding apparatus of FIG. 1 with the grinding element concentrically aligned with the receptacle.
Figure 7:
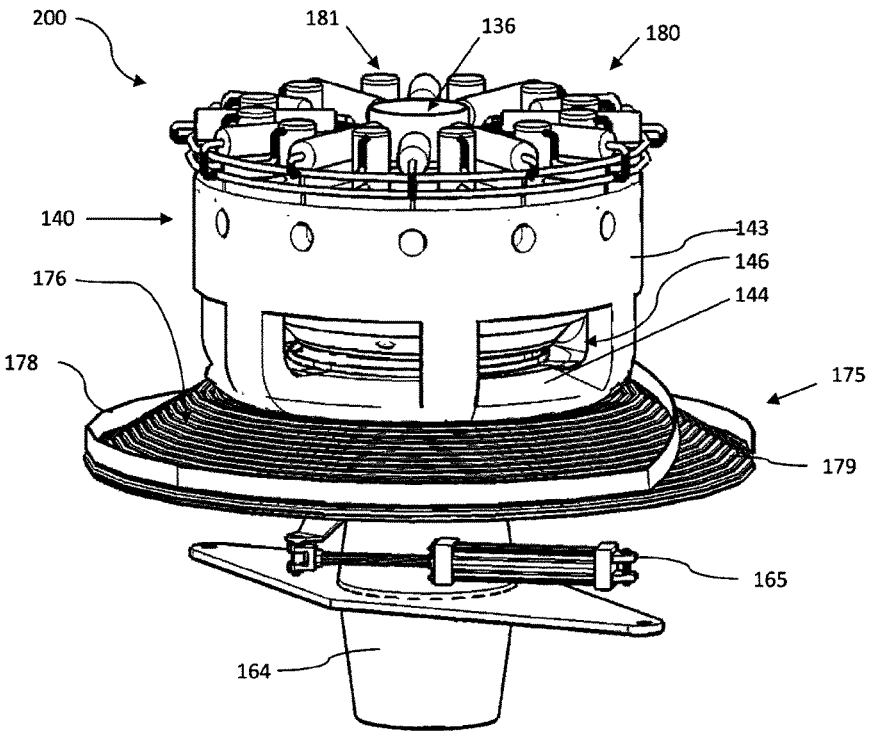
FIG. 7 is a first isometric view of a grinding apparatus according to a second embodiment.
Figure 8:
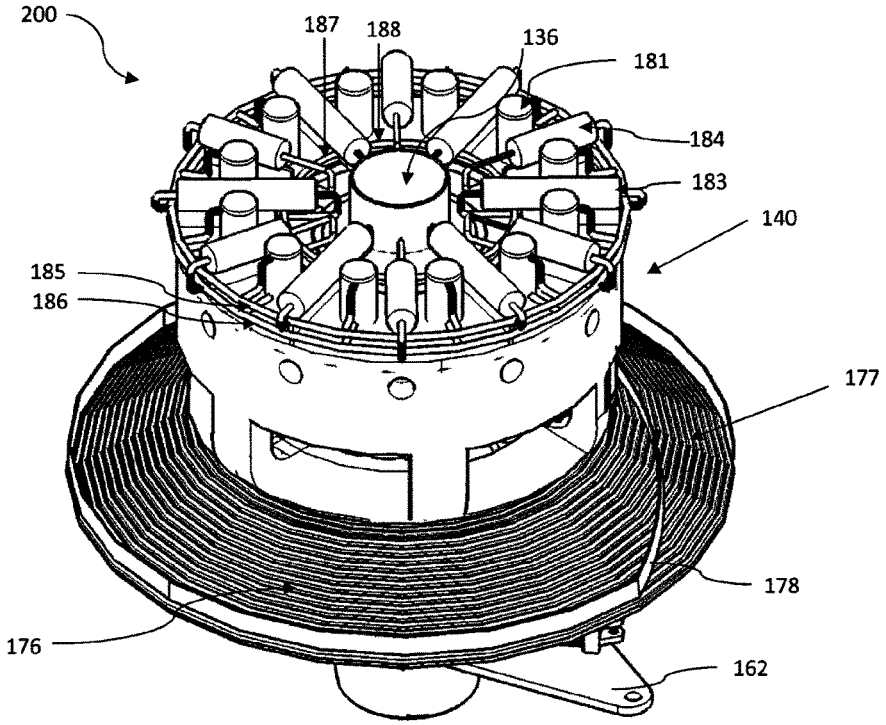
FIG. 8 is a second isometric view of the grinding apparatus of FIG. 7.
Figure 9:
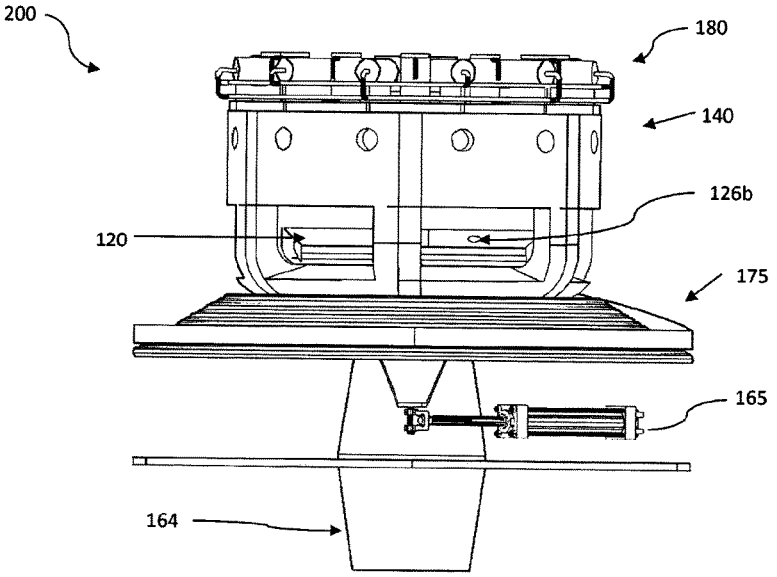
FIG. 9 is a front elevation view of the grinding apparatus of FIG. 7.
Figure 10:
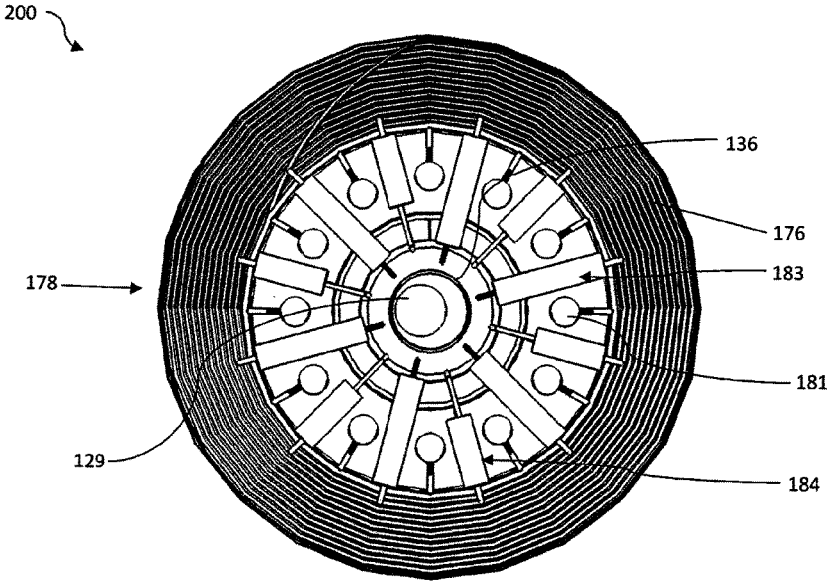
FIG. 10 is a plan view of the grinding apparatus of FIG. 7.

The receptacle 110 may also be rotatably driven about the receptacle axis A, either by way of a separate drive or by coupling the receptacle 110 to the grinding element 120. As best depicted in FIG. 6, this coupling may be achieved by way of a series of drive pins 163 projecting from the upper face of the housing floor 144 received within corresponding drive cavities 128 formed in the lower face 127 of the grinding element head 124. The drive cavities 128 are oversized to allow for the eccentric offset of the respective axes of rotation of the housing 140 (which rotates with the receptacle 110) and the grinding element 120, being the receptacle axis A and the grinding element axis B. For operations where it is desired not to actively rotationally drive the receptacle 110, the drive pins 163 may be omitted. It is also envisaged that the receptacle 110 might be actively rotationally driven about the receptacle axis A without rotationally driving the grinding element 120. Such rotational driving of the receptacle 110 might conveniently be achieved by rotationally driving the housing 140 by way of a belt drive or ring gear and pinion drive system or similar drive means. The receptacle 110 might, for example, be driven by a gearless drive (ring motor) as used on tumbling mills. Such a drive would involve motor rotor elements being secured to the housing 140, with a stationary stator assembly surrounding the rotor elements. The housing 140 would then become the rotating elements of a large slow speed synchronous motor.

In the arrangement of the first embodiment, the eccentric arrangement 160 enables the offset distance D between the receptacle axis A and the grinding element axis B to be selectively adjusted. The eccentric arrangement 160 comprises the eccentric bush 161 and a radially projecting lever arm 162 that is fixed to the lower end of the eccentric bush 161. By virtue of the eccentricity of the eccentric bush 161, rotational displacement of the eccentric bush 161 by way of displacement of the lever arm 162 acts to displace the grinding element shaft 125 extending through the eccentric bush 161, and thereby the grinding element axis B, relative to the base 150 and thereby, relative to the receptacle axis A. FIG. 5 depicts the eccentric bush 161 in a first orientation providing a maximum offset distance D, whilst FIG. 6 depicts the eccentric bush 161 in an opposing second orientation which provides a minimum offset distance D. In the first embodiment, the offset distance D may be selectively adjusted between 0 and 10 mm. Rather than the eccentric arrangement 160 display the grinding element axis B, alternative eccentric arrangements are envisaged that operate to displace the receptacle axis A.

The grinding chamber 116 may be partly filled with grinding media 170 where desired to supplement the effectiveness of the comminution process, although the use of grinding media 170 is optional. The grinding media 170 would be formed of a material with a greater density and hardness than that of the feed particles that are to be reduced in size through the grinding operation. The grinding media may, for example, be formed of high carbon steel, and will have a size greater than the annular gap defined by the grinding chamber outlet 117, whilst smaller than the minimum width of the grinding chamber 116. This sizing will ensure that a high percentage of the grinding media 170 will remain within the grinding chamber 116 and that no individual particle of the grinding media 170 will engage both the housing element inner surface 111 and grinding element outer surface 112 during operation, which may otherwise jam the grinding apparatus 100. The grinding media 170 will eventually wear, resulting in undersized grinding media passing naturally out of the grinding chamber 116 via the discharge outlet 117. The grinding media 170 size may also be managed by periodically opening the annular gap defining the discharge outlet to deliberately force smaller worn particles of grinding media 170 from the grinding chamber 118, which would otherwise merely take up volume of the grinding chamber 116 that could be occupied by feed particles. The grinding media 170 may be comprised in part by larger "competent" feed particles.

Operation of the grinding apparatus 100 will now be described with particular reference to FIG. 5. The grinding apparatus 100 is first set up to adjust the annular gap defining the discharge outlet 117 to suit the maximum size of ground particle discharge desired. As noted above, the annular gap defining the discharge outlet 117 may be adjusted by adjusting the vertical location of the receptacle 110 relative to the housing 130 by way of the screw threaded mounting arrangement. A desired offset distance D, which will typically be determined following trial grinding of particular forms and size of feed particles, and giving consideration to the torque of the drive means, will also be offset by way of the eccentric arrangement 160.

Feed particles will be fed into the grinding chamber 116 under the action of gravity through the feed inlet 113. The feed particles may be introduced into the grinding chamber 116 in competent or non-competent form. Process fluid, such as water, may also be added to the grinding chamber 116 via the receptacle upper opening 113 and/or the fluid feed passage 167 to reduce friction within the grinding chamber 116 and to transport material within the grinding chamber 116 in slurry form.

The drive means rotationally drives the grinding element 120 by way of the grinding element shaft 125, about the grinding element axis B. During operation, the grinding element axis B remains stationary. That is, the grinding element B does not gyrate during operation. Feed particles will travel downwardly and outwardly along the grinding chamber 116 towards and through the annular channel 123 and towards the annular dam 122 at the radially outer extent of the grinding chamber 116. The centrifugal forces acting on the feed particles result from frictional forces between the rotating grinding element outer wall 121 and feed particles, generating a rotational flow of the feed particles through the annular grinding chamber 116. In arrangements where the drive pins 163 are used to rotationally drive the receptacle 110, rotation of the receptacle inner wall 111 will act to further drive the feed particles, and grinding media 170, along the grinding chamber 116.

In configurations where the receptacle 110 is left to freely rotate about the receptacle axis A, with omission or removal of the drive pins 163, interference contact of the receptacle inner wall 111 with content of the grinding chamber 116 will cause the receptacle 110 to rotate about the receptacle axis A, similar to a planetary gear system. The receptacle 110 will nominally rotate at a speed reduced by the ratio of the diameter of the receptacle inner wall 111 to that of the grinding element outer wall 121, less some allowance for the disparity of the diameter ratio changing across the extent of the grinding chamber 116 and process sliding friction effects. The grinding media 170 and feed particles inside the grinding chamber 116 will be forced to shear against each other because they will be forced to behave similarly to planetary gears that are in contact with each other. Due to the significantly greater mass inertia of the receptacle 110 relative to the mass inertia of the grinding media 170, the receptacle 110 (and coupled housing 140) will store significant potential energy (similar to a conventional flywheel) that will leverage over any sporadic adverse instantaneous comminution phenomena and will therefore discharge kinetic energy back into the grinding media 170 as required to overcome any such comminution phenomena. Accordingly, energy will ebb and flow in and out of the receptacle 110. The grinding element outer wall 121 and receptacle inner wall 111 act as inner and outer rolling surfaces which, unlike high pressure grinding rolls, compress the feed particles with the rolling surfaces multiple times as the feed particles are forced through the grinding chamber 116.

The eccentric offset between the receptacle axis A and the grinding element axis B, coupled with rotation of the receptacle 110 and grinding element 120, result in a sinusoidal excitation of the contents of the grinding chamber 116. The configuration of the grinding chamber 116 as defined by the receptacle inner wall 111 and grinding outer wall 121, is such that the grinding media 170, feed particles and process fluid are restrained in the outward radial and axial directions (and to a lesser extent, circumferentially and in the inward radial direction). The nature of the sinusoidal excitation will be of rolling compaction "pressure" and "release" cycles. Maximum compaction in the pressure cycle will occur within the compression zone 116*a* where the grinding chamber 116 has a minimum average width whilst the maximum "release" occurs around the release zone 116*b* of the grinding chamber 116 where the average width of the grinding chamber 116 is a maximum. During the "release" portion of the sinusoidal cycle, the centrifugal forces will cause the grinding media and feed particles to rearrange their position and orientation to the extent of clustering up to fill the increased void space in the grinding chamber 116 that results from the "release". During the "pressure" portion of the sinusoidal cycle, the centrifugal forces restrain the grinding media and feed particles whilst they rearrange their position and orientation to fit within the narrower compression zone 116*a* of the grinding chamber 116 caused by the "pressure" portion of the sinusoidal cycle. An increased offset distance D between the receptacle axis A and the grinding element axis B will create a greater depth of rolling penetration of the grinding element 120 into the bed of grinding media 170 and feed particles in the compression zone 116*a*, increasing the pressure applied to the bed. This will also result in a need for greater torque applied by the drive means to drive the grinding element 120. Specific compression pressures in the compression zone of nominally 3 to 5 MPa will typically be generated.

After numerous cycles of comminution created by the sinusoidal pressure and release cycles, feed particles will be ground to a sufficiently small size to constitute discharge particles that are capable of being discharged from the grinding chamber 116 by way of the discharge outlet 117 or the overflow passage 126. The discharge particles may then be processed as further desired, including by way of a screen that may be mounted on the base 150 or housing 140, as will be described further in relation to the second embodiment below.

The interaction of the grinding media 170 and feed particles during the "pressure" portion of the cycle will have a degree of leverage and hence multiply the local contact pressure between particles at the peak of the sinusoidal pressure wave. This pressure wave will also propagate into the process fluid, potentially causing high pressure flow between the grinding media 170 and the feed particles. The pressure wave will typically travel continuously and repetitively circumferentially around the grinding chamber 116 with rotational speed approximating that of the grinding element 120.

The rotational speed of the grinding element 120 should be selected to be sufficient to promote density separation, segregation and/or distribution of the mixture of process particles and process fluid within the grinding chamber 116 by centrifugal force in the radial direction. Stokes Law suggests that the settling velocity of the feed particles will be proportional to the diameter of the particle to the exponent power of two. Larger particles will thus have a greater settling velocity and will thus arrive first at the outer periphery of the grinding chamber 116. The larger diameter feed particles should thus arrive at the radially outer, and reduced width, region of the grinding chamber 116 and receive comminution from the grinding media 170 before the smaller diameter feed particles. The feed particles will, however, continue to receive comminution whilst travelling radially outwardly along the grinding chamber 116. The grinding media 170, which will be denser and typically larger in size than the feed particles, will preferentially occupy the outer circumferential regions of the grinding chamber 116 to the effect of centrifugal force also, according to Stokes Law discussed above.

Large particles in a vibrated granular system are known to rise to the top, providing size separation of the particles. Similarly, the sinusoidal excitation of the particles within the grinding chamber 116 will also invariably cause size separation of the particles contained therein. The forced particle flow through the grinding chamber 116, synergized with size separation, may result in discharge particles having a narrower, and more controlled, upper and lower limits of size distribution than those experienced by conventional comminution processes.

Sinusoidal excitation within the grinding chamber 116 may also create liquefaction. Process fluid, with the lower sized fraction of discharge particles, in fluidised form, are capable of being liberated from the contents of the grinding chamber 116 by liquefaction. This will create the potential for slurry flow defying gravity and defying centrifugal forces within the grinding chamber 116. The slurry may flow on top of the bed of grinding media 170 and feed particles in the grinding chamber 116 and either discharge from the discharge outlet 117 by way of the grinding chamber outlet or through the overflow passage 126.

The grinding apparatus 100 can be seen to combine and synergise the compression benefits of high pressure grinding rolls with the attrition benefits of prior art tumbling mills. The grinding apparatus 100 is expected to achieve energy efficiencies similar to that of high pressure grinding rolls, and over much greater particle size ranges as handled by tumbling mills. The approach angle of the two rolling surfaces defined by the receptacle inner wall 111 and grinding element outer wall 121 entering the compression zone within the compression chamber 116 (being eccentric, with one rolling surface within the other) is negligible in comparison to the approach angle of the two rolling surfaces entering the compression zone of conventional contra roll high pressure grinding rolls. This negates the need for dry friction to force feed particles into the compression zone 116*a* and enhances the volumetric flow of feed particles for comminution. The general arrangement of the grinding apparatus 100, depending on specific size and power of the grinding apparatus 100, may achieve relatively efficient comminution of feed particles up to nominally 200 mm to a discharge particle size of about 20 μm.

A grinding apparatus 200 according to a second embodiment is depicted in FIGS. 7 to 12 of the accompanying drawings. The grinding apparatus 200 is of the same basic form as the grinding apparatus 100 of the first embodiment. Accordingly, identical or equivalent features of the grinding apparatus 200 to that of the grinding apparatus 100 are identified in the accompanying representations with identical reference numerals. The grinding apparatus 200 is of the same basic form as the grinding apparatus 100, with the inclusion of additional auxiliary systems, removal of the drive pins 163 provided in the first embodiment for rotational driving of the receptacle 110 with the grinding element 120, and an alternate arrangement for mounting the receptacle 110 within the housing 140. The description of the grinding apparatus 100 above thus equally applies to the grinding apparatus 200, as modified by the description set out further below.

Whilst the grinding apparatus 100 of the first embodiment is intended to be a relatively rudimentary and small "pilot" form of the described grinding apparatus, the grinding apparatus 200 of the second embodiment is intended to represent a larger commercial version of the grinding apparatus. In particular, the grinding apparatus 200 is approximately 2000 mm in diameter, and is intended to be driven at a rotational speed of the order of 80 rpm utilizing a nominal 1.1 MW drive motor 164. The grinding apparatus 200 is configured to receive feed particles of a size up to 200 mm, with the annular gap defining the discharge outlet 117 being adjustable between 0 and 165 mm (with this large range primarily being for the purpose of purging grinding media 170 from the grinding chamber 116). The offset distance D between the receptacle axis A and the grinding element axis B is also adjustable between 0 and 50 mm.

Figure 11:
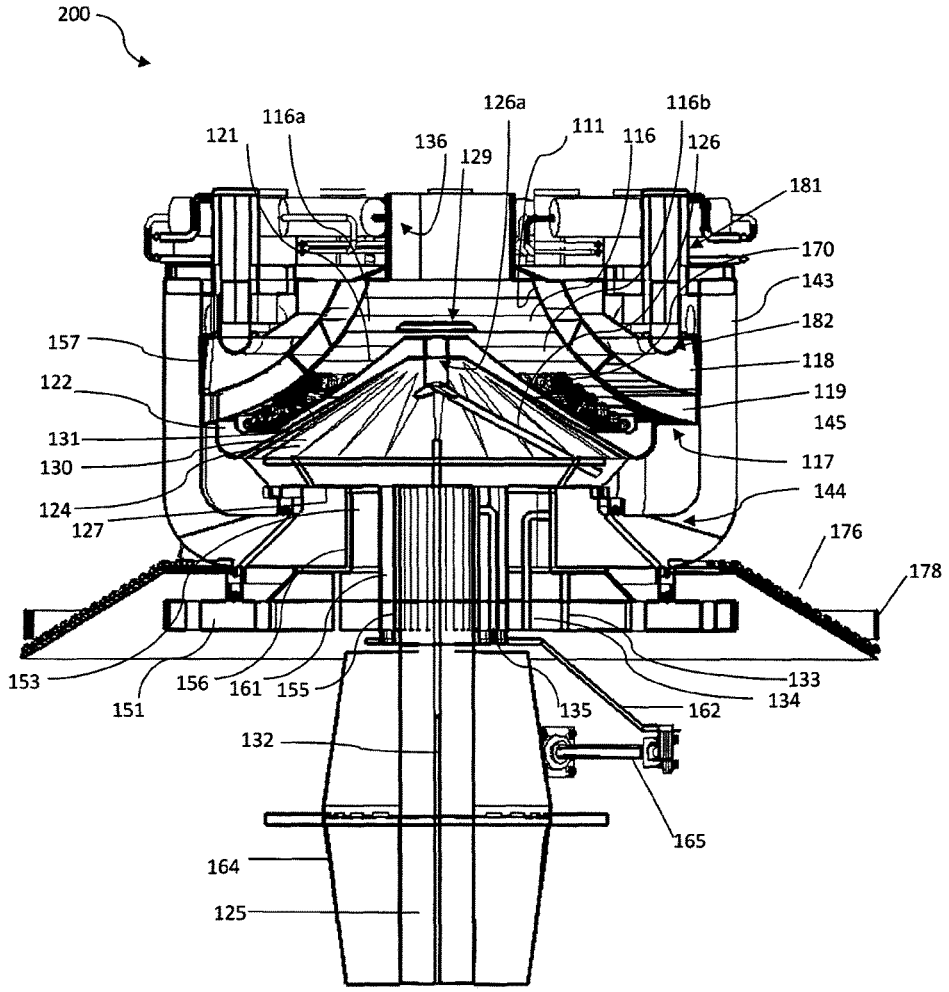
FIG. 11 is a schematic cross-sectional view of the grinding apparatus of FIG. 7.
Figure 12:
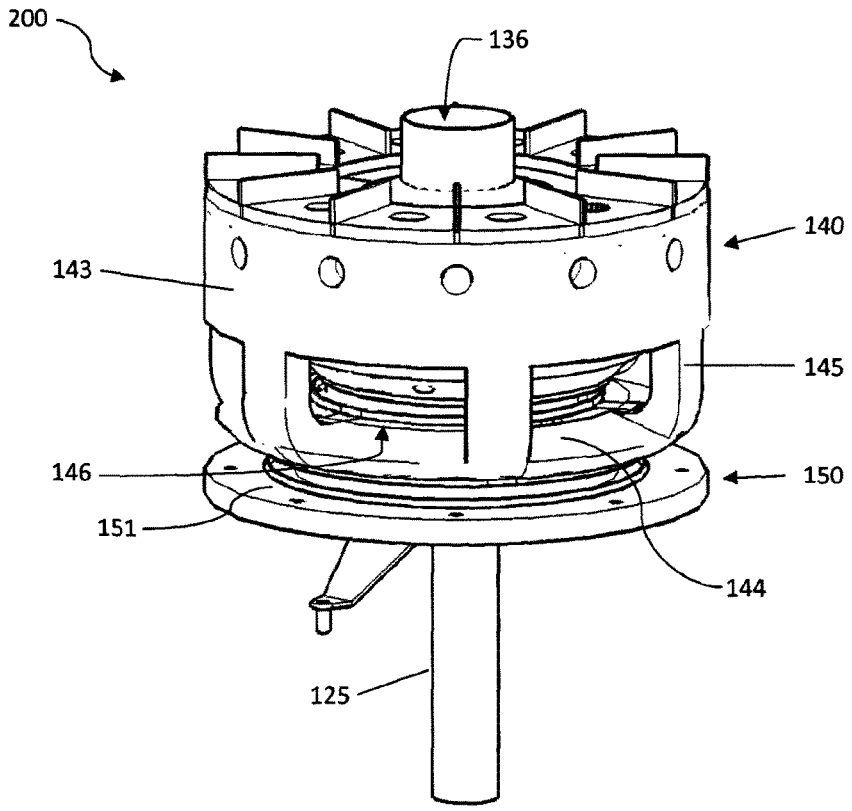
FIG. 12 is fragmentary isometric view of the grinding apparatus of FIG. 7.

In the grinding apparatus 200, the receptacle 110 is in the form of a receptacle body 118 with a replaceable receptacle liner 119 secured to the receptacle 118 and defining the receptacle inner wall 111. The receptacle liner 119 may be formed in separate segments for ease of replacement. The receptacle inner wall 111 is again in the form of a surface of revolution extending about the receptacle axis A and tapering towards the feed inlet 113. However, rather than being frustoconical as with the first embodiment, (where the receptacle inner wall 111 is linear in any cross-section) in the second embodiment the receptacle inner wall 11 is convex in any radial cross-section, as best shown in FIG. 11. This particular form assists in redirecting the original vertical path of feed particles as they enter the feed inlet 113 to a more radial direction as the feed particles pass through the grinding chamber 116 towards the discharge outlet 117. In the grinding apparatus 200, a feed chute 136 extends upwardly from the feed inlet 113 for the passage of feed particles (and process fluid, where utilized) into the grinding chamber 116.

The grinding element 120 is in the form of a grinding element body 130 and a grinding element liner 131 secured to the grinding element body 130, and defining the grinding element outer wall 121. As with the receptacle liner 119, the grinding element liner 131 may be formed in segments to assist in replacement. The grinding element outer wall 121 is again in the form of a surface of revolution extending about the grinding element axis B, tapering towards the top of the grinding element 120. The grinding element outer wall 121, rather than being frustoconical in form, is concave in any radial cross-section, as again best shown in FIG. 11.

In the grinding apparatus 200, the overflow passage 126 is arranged such that the overflow passage inlet 126*a* extends vertically through the grinding element liner 131 centrally at the top of the grinding element 120. Rather than being integrally formed with the grinding element body 130 or grinding element liner 131, the annular dam 122 of the grinding element 120 is formed separately and extends around the circumference of the grinding element liner 131 so as to define the annular channel 123. The annular dam 122 may be formed of the same material as either the grinding element body 130 or grinding element liner 131, or alternatively may be formed of an alternate material suitable to create a seal with the bottom face of the receptacle 110, defined by the receptacle liner 119, when the annular gap defining the discharge outlet 117 is closed. To prevent feed particles that enter the grinding chamber 116 through the feed inlet 113 from entering the overflow passage inlet 126*a*, the cap 129 of the grinding element 120 is suspended above the overflow passage inlet 126*a*.

The grinding apparatus 200 is provided with a lubrication system to lubricate the various bearing surfaces and bushes. A first lubricant supply passage 132 extends up the grinding element shaft 125 and branches radially outwardly through the grinding element head 124 to lubricate the bearing surfaces of the lower face 127 of the grinding element head 124 and the upper face of the housing floor 144. A series of second lubricant passages 133 extend through the outer boss 152 of the base 150 to lubricate the bearing surfaces of the lower face of the housing floor 144 and the upper face of the outer boss 152 of the base 150. A series of third lubricant passages 134 passes through the inner boss 153 of the base 150 to lubricate the cylindrical second bush 156 between the inner boss 153 and housing floor 144. A series of fourth lubricant supply passages 135 extends through the eccentric bush 161 to lubricate the first bush 155.

The grinding element 120 is driven about the grinding element axis B by way of a drive means in the form of drive motor 164 that drives the grinding element shaft 125. The lever arm 162 of the eccentric arrangement 160 is here driven by way of a hydraulic ram 165.

The grinding apparatus 200 is further provided with a discharge product collection system 175 that receives ground discharge product after it is ejected from the grinding chamber 116 through the discharge outlet 117 or overflow passage 126. The collection system 175 includes a screen 176 located beneath the grinding chamber 116, and particularly extending circumferentially about the grinding element 120 directly beneath the housing 140. The screen 176 is secured to the housing floor 144 such that it rotates with the housing 140 and is configured to receive discharge particles as they pass either from the discharge outlet 117 or overflow passage outlet 126*b* over the housing floor 144 through the openings 146. The screen 176 is in a mesh form with mesh openings sized to only allow discharge particles smaller than the size of the mesh openings to pass therethrough, where they will typically be collected in a pan (not depicted) arranged beneath the screen 176.

An oversize product chute 177 is defined by a wall 178 extending about the majority of the circumferential periphery of the screen 176, with a chute opening 179 of the oversize product chute 177 being defined at the open edge of the screen 176. The wall 178 defining the oversize product chute 177 is fixed in relation to the base 150, such that it does not rotate with the screen 176 ensuring the wall 178 guides the oversize product off the screen 176 through the opening 179. The oversize product chute 177 acts to collect oversize product discharged from the grinding chamber 116 which will not pass through the mesh openings of the screen 176, guiding the oversize product along the oversize product chute 177 and out the chute opening 179 by virtue of the rotation of the screen 176 with the housing 140.

In the grinding apparatus 200 of the second embodiment, rather than being fixed to the housing 120 with a screw threaded arrangement, the receptacle 110 is mounted within the housing body 143 by way of a third bush 157 that separates the receptacle 110 from the housing body 143 with the intent to permit oblique axial movement of the receptacle 110 in relation to the housing 140. The third bush 157 is lubricated by high pressure grease, and protected from foreign material ingress by a bonnet.

The grinding apparatus 200 is provided with a suspension system 180 providing for relative vertical displacement between the grinding element 120 and the receptacle 110 in the event of incompressible material in the grinding chamber 116 becoming wedged between the receptacle inner wall 111 and grinding element outer wall 121, which may otherwise jam, and potentially damage, the grinding apparatus 200.

The suspension system 180 comprises a series of circumferentially spaced double acting jacking rams 181 that are each operable in a vertical axial direction and have a ram actuator 182 that is secured to the top of the receptacle 110. Axial displacement of the ram actuators 182 provide for vertical displacement of the receptacle 110 relative to the housing 140 and, accordingly, vertical displacement relative to the grinding element 120. Accordingly, retraction of the ram actuators 182 results in displacement of the receptacle 110 upwardly, increasing the annular gap defining the discharge outlet 117 and increasing the width of the grinding chamber 116. The double acting jacking rams 181 may be actively driven to selectively adjust the annular gap defining the discharge outlet 117. The hydraulic rams 181 are also reactive to high compressive pressures being conveyed to the ram actuators 182 during operation in the event that incompressible substances or events within the grinding chamber 116 or discharge outlet 117 become wedged between the receptacle inner wall 111 and grinding element outer wall 121.

The hydraulic rams 181 are each operatively associated with compression and evacuation accumulators 183, 184 communicating with opposing operative ends of the double acting jacking rams 181 by way of pneumatic and hydraulic circuits. The pneumatic circuit of the suspension system 180 acts to provide for displacement of the receptacle 110 when an over pressure event occurs within the grinding chamber 116, whilst the hydraulic circuit is actively operated to adjust the position of the receptacle 110, particularly to adjust the annular gap defined by the discharge outlet 117. The pneumatic circuit provides for the suspension system 180 to react to excessive pressure acting on the receptacle inner wall 111 to compress the hydraulic rams 181, allowing the receptacle 110 to move vertically to allow any particles wedged between the receptacle inner wall 111 and grinding element outer wall 121 to be freed. The pneumatic circuit comprises a pneumatic compression ring main 187 and pneumatic evacuation ring main 188, which will each typically be charged with nitrogen. The hydraulic circuit comprises a hydraulic compression ring main 185 and hydraulic evacuation ring main 186.

A person skilled in the art will appreciate various other modifications to the grinding apparatus 100, 200 described that may be made.

The invention claimed is:

1. A grinding apparatus comprising:

a receptacle having a receptacle inner wall defining a receptacle cavity, said receptacle inner wall being a surface extending about a central vertically extending receptacle axis, said receptacle being rotatable about said receptacle axis;

a grinding element having a grinding element outer wall, said grinding element outer wall being a surface extending about a central vertically extending grinding element axis, said grinding element axis being generally parallel to said receptacle axis, and offset from said receptacle axis by an offset distance, said receptacle inner wall and said grinding element outer wall together defining a grinding chamber within said receptacle cavity, said grinding chamber having a generally annular cross-section; and a drive adapted to rotationally drive said grinding element about said grinding element axis and/or to rotationally drive said receptacle about said receptacle axis;

wherein an annular gap is defined between said receptacle and said grinding element at a radially outer extremity of said grinding chamber, said annular gap defining a circumferentially extending discharge outlet; and wherein said annular gap is selectively adjustable to a closed state.

2. A grinding apparatus comprising:

a receptacle having a receptacle inner wall defining a receptacle cavity, said receptacle inner wall being a surface extending about a central vertically extending receptacle axis, said receptacle being rotatable about said receptacle axis;

a grinding element having a grinding element outer wall, said grinding element outer wall being a surface extending about a central vertically extending grinding element axis, said grinding element axis being generally parallel to said receptacle axis, and offset from said receptacle axis by an offset distance, said receptacle inner wall and said grinding element outer wall together defining a grinding chamber within said receptacle cavity, said grinding chamber having a generally annular cross-section; and a drive adapted to rotationally drive said grinding element about said grinding element axis and/or to rotationally drive said receptacle about said receptacle axis;

wherein an overflow passage extends through said grinding element between an upper portion of said grinding chamber and an exterior of said grinding chamber.

3. A grinding apparatus comprising:

a receptacle having a receptacle inner wall defining a receptacle cavity, said receptacle inner wall being a surface extending about a central vertically extending receptacle axis, said receptacle being rotatable about said receptacle axis;

a grinding element having a grinding element outer wall, said grinding element outer wall being a surface extending about a central vertically extending grinding element axis, said grinding element axis being generally parallel to said receptacle axis, and offset from said receptacle axis by an offset distance, said receptacle inner wall and said grinding element outer wall together defining a grinding chamber within said receptacle cavity, said grinding chamber having a generally annular cross-section; and a drive adapted to rotationally drive said grinding element about said grinding element axis and/or to rotationally drive said receptacle about said receptacle axis;

wherein a fluid feed passage extends through said grinding element and communicates with said grinding chamber.

4. The apparatus of claim 3, wherein said drive is adapted to rotationally drive said grinding element only.

5. The apparatus of claim 3, wherein said drive is adapted to rotationally drive said grinding element and said receptacle.

6. The apparatus of claim 3, wherein said grinding chamber has a feed inlet at an upper end of said receptacle.

7. The apparatus of claim 6, wherein said receptacle inner wall tapers towards said feed inlet, and said grinding element outer wall tapers towards said feed inlet.

8. The apparatus of claim 3, wherein, along any radial plane, a width of said grinding chamber, defined as the minimum distance between said grinding element outer wall at a given point in the radial plane and said receptacle inner wall, tapers towards a lower end of said grinding chamber.

9. The apparatus of claim 3, wherein said offset distance is selectively adjustable.

10. The apparatus of claim 9, wherein said grinding element comprises a grinding element head defining said grinding element outer wall and a grinding element shaft rotatably mounted within an eccentric arrangement configured to selectively displace said grinding element axis to adjust said offset distance.

11. The apparatus of claim 3, wherein an annular gap is defined between said receptacle and said grinding element at a radially outer extremity of said grinding chamber, said annular gap defining a circumferentially extending discharge outlet.

12. The apparatus of claim 11, wherein said annular gap is selectively adjustable.

13. The apparatus of claim 11, wherein said annular gap is adjustable to a closed state.

14. The apparatus of claim 11, wherein said receptacle is mounted in a housing by a screw threaded arrangement operable to adjust said annular gap.

15. The apparatus of claim 11, wherein said grinding element further comprises an annular dam defining a circumferentially extending periphery of said grinding element, said annular gap being defined between a top edge of said annular dam and a lower face of said receptacle.

16. The apparatus of claim 3, wherein an overflow passage extends through said grinding element between an upper portion of said grinding chamber and an exterior of said grinding chamber.

17. The apparatus of claim 3, wherein said grinding apparatus further comprises a screen located beneath said grinding chamber for receipt of material discharged from said grinding chamber and configured to allow material below a predetermined size to pass through said screen.

18. The apparatus of claim 17, wherein said screen extends circumferentially about said grinding element.

19. The apparatus or claim 18, wherein said screen is rotationally fixed in relation to said receptacle.

20. The apparatus of claim 18, wherein said grinding apparatus further comprises an oversize product chute arranged on said screen to guide material exceeding said predetermined size from a top surface of said screen.

21. The apparatus of claim 3, wherein said grinding apparatus further comprises grinding media in said grinding chamber.

22. The apparatus of claim 3, wherein said grinding apparatus further comprises a suspension system providing for relative vertical displacement between said grinding element and said receptacle in the event of incompressible material in said grinding chamber becoming wedged between said receptacle inner wall and said grinding element outer wall.

23. The apparatus of claim 22, said suspension system comprises a plurality of hydraulic jacking rams.

24. The apparatus of claim 3, wherein said receptacle comprises a receptacle body and a replaceable receptacle liner mounted on said receptacle body and defining said receptacle inner wall.

25. The apparatus of claim 3, wherein said grinding element comprises a grinding element body and a grinding element liner mounted to said grinding element body and defining said grinding element outer wall.

* * * * *